United States Patent [19]

Hoeffken

[11] Patent Number: 4,510,660

[45] Date of Patent: Apr. 16, 1985

[54] METHOD OF MANUFACTURING A TWO-PLATE HEAT EXCHANGER

[75] Inventor: Russell W. Hoeffken, Belleville, Ill.

[73] Assignee: Snyder General Corporation, Red Bud, Ill.

[21] Appl. No.: 417,672

[22] Filed: Sep. 13, 1982

Related U.S. Application Data

[60] Continuation-in-part of Ser. No. 295,041, Aug. 21, 1981, Pat. No. 4,441,241, which is a division of Ser. No. 178,338, Aug. 15, 1980, Pat. No. 4,298,061.

[51] Int. Cl.[3] ..... B21D 53/04

[52] U.S. Cl. ..... 29/157.3 D; 29/157.3 R; 29/514; 165/170

[58] Field of Search ..... 29/157.3 D, 157.3 V, 29/511; 403/282, 284, 285, 274, 335, 338; 165/170; 220/77, 76, 78; 126/65, 67, 98, 118

[56] References Cited

U.S. PATENT DOCUMENTS

| | | | |
|---|---|---|---|
| 601,787 | 4/1898 | Bloch | 220/77 |
| 697,955 | 4/1902 | Thompson | 29/521 |
| 1,158,576 | 11/1915 | Sonneborn | 29/157.3 D |
| 3,643,323 | 2/1972 | Harris et al. | 29/511 |
| 3,813,752 | 6/1974 | Bemrose et al. | 29/157.3 D X |

*Primary Examiner*—Carl E. Hall
*Assistant Examiner*—John T. Burtch
*Attorney, Agent, or Firm*—Hubbard, Thurman, Turner & Tucker

[57] ABSTRACT

A heat exchanger unit having opposed pan shaped sections with perimeter flanges which are folded one over the other to secure the sections together. The section having the inner flange is formed with a displaced flange portion or bead all along the perimeter flange portions, which bead is elastically displaced by the folded over flange to form a substantially leakproof joint.

7 Claims, 7 Drawing Figures

METHOD OF MANUFACTURING A TWO-PLATE HEAT EXCHANGER

CROSS-REFERENCE TO RELATED APPLICATION

This application is a continuation-in-part of co-pending application Ser. No. 295,041 filed Aug. 21, 1981 now U.S. Pat. No. 4,441,241 which is a division of application Ser. No. 178,338 filed Aug. 15, 1980, now U.S. Pat. No. 4,298,061.

BACKGROUND OF THE INVENTION

1. Field of the Invention

The present invention pertains to a heat exchanger unit particularly adapted for gas fired hot air furnaces wherein two pan shaped sections are joined together along cooperating flanges which are folded one over the other and crimped tightly to form a substantially leakproof joint.

2. Background

In the development of so called clamshell type heat exchanger units certain improvements have been made wherein a seam is sealed by folding a flange portion of one shell section over a cooperating flange of the other shell section and crimping the folded flanges to securely lock the sections together and prevent undesirable relative movement during the cyclical heating and cooling of the heat exchanger unit. Although the inventions disclosed and claimed in the above referenced application and patent comprise a significant improvement in shell type heat exchanger units the further development of the inventive concept has included the desideratum of achieving a more consistent seal around the edges of the clamshell sections. The formation of a substantially gas-tight seal at the seam between the sections of a clamshell type heat exchanger is, of course, important with respect to preventing the leakage of combustion products during normal operating conditions from the interior of the heat exchanger into the plenum through which conditioned air is being circulated. On the other hand, under certain operating conditions it may be desirable to have a seam which will temporarily yield to excessive pressure within the interior of the heat exchanger to release gases to reduce the pressure without undergoing a catastrophic failure of the heat exchanger itself. Accordingly, it is a primary object of the present invention to provide a clamshell type heat exchanger having opposed pan shaped sections, each formed with a peripheral flange, which are joined together and formed into a unitary structure by folding one flange over the other to form a substantially gas-tight or leakproof seal. This objective has been met by the invention described and claimed herein.

SUMMARY OF THE INVENTION

The present invention provides an improved clamshell heat exchanger unit including opposed pan shaped or clam shell type sheet metal sections which are joined together along a peripheral edge by forming each of the sections with flanges which are configured to permit folding one flange over the other and crimping the flanges in such a way as to securely lock the shell sections together to form a substantially gas-tight seal and to prevent relative movement of the sections during cyclical heating and cooling of the heat exchanger.

In accordance with an important aspect of the present invention the flange of one of the sections is formed with an elongated peripheral bead or displaced portion. The cooperating flange on the other shell section is folded over the first flange and pressed against the bead sufficiently to displace it elastically and to sandwich the first flange between the folded flange portions of the other section. The elastic displacement of the bead assures that the first or sandwiched flange presses tightly against the opposed flange portions of the other section to form a substantially gas-tight seal at normal operating pressures and temperatures.

Several advantages arise from the formation of the peripheral bead type seal for the heat exchanger unit in accordance with the present invention. The formation of the bead on the one flange causes the peripheral edge of the flange to be bent at an angle with respect to the plane of the flange of the other section so that during the folding and pressing process the edge of the first flange will forcibly engage the surface of the inner peripheral portion of the second flange. The arched portion of the first flange forming the bead is flattened during the folding process and the peripheral edge of the flange is forced into the bottom of the recess formed by the folded over flange to thereby also enhance the seal between the flanges. Another important feature of the improvement of the present invention is that the elastic memory retained by the bead or arched flange portion provides a constant biasing force which tightly presses the inner flange against the opposed portions of the outer and folded flange. Such an arrangement permits the use of pressing or forming equipment wherein the forming die members may be slightly misaligned without causing the formation of an ineffective seal. Moreover, such a joint as been observed to yield under excessive pressure within the heat exchanger to permit pressure release or leakage and then reseal itself when the pressure is reduced.

In accordance with the present invention there has also been developed an improved method of forming a heat exchanger unit having opposed pan shaped or clam shell type sections wherein each section has a flange along one or more edges and the flange of one section is folded over a cooperating flange of the other section to join the sections together to form a substantially gas-tight seal. By providing the inner flange with a raised peripheral bead that is elastically displaced upon folding the flange of the other section over the inner, flange an improved seal between the flanges is formed and is enhanced by a further crimping operation to reduce the tendency for the shell sections to move relative to each other under stresses induced by cyclical heating and cooling of the heat exchanger unit. In fact, a somewhat synergistic effect has been realized by the method and apparatus of the present invention wherein the provision of the beaded flange and the folded and crimped flanges yields a heat exchanger which has superior operating characteristics and is more economical to manufacture then prior art apparatus.

Those skilled in the art will recognize the above-described features and superior aspects of the present invention as well as other advantages thereof upon reading the detailed description which follows in conjunction with the drawings.

DESCRIPTION OF THE PREFERRED EMBODIMENTS

Figure 1:
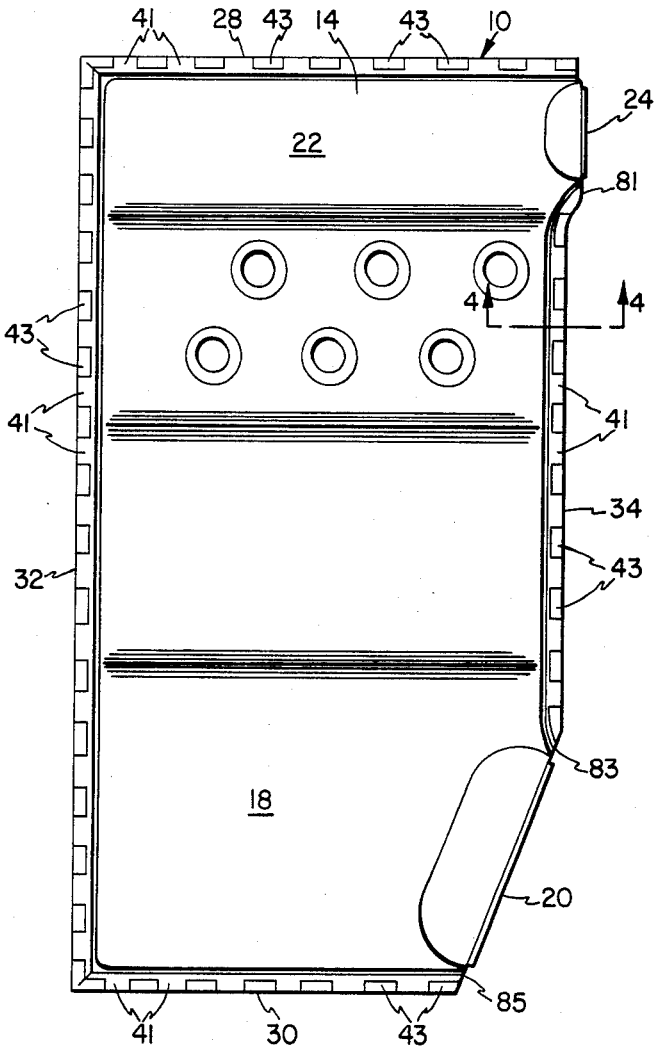
FIG. 1 is a side elevation view of a heat exchanger unit having edges formed in accordance with the present invention.

In the description which follows like parts are marked throughout the specification and drawings with the same reference numerals, respectively. The drawings are not necessarily to scale and certain features may be exaggerated in scale in order to better illustrate the invention.

Figure 2:
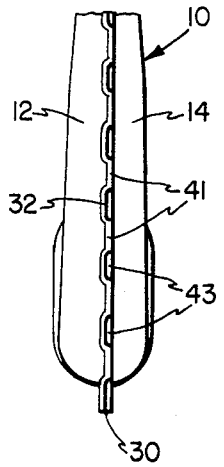
FIG. 2 is a partial rear elevation of the heat exchanger unit illustrated in FIG. 1.

Referring particularly to FIGS. 1 and 2 there is illustrated an air-to-air heat exchanger unit particularly adapted for use in a gas fired hot air furnace, which heat exchanger is generally designated by the numeral 10. The heat exchanger 10 includes opposed clamshell or pan shaped sections 12 and 14 which are joined together to form an enclosed chamber 16, FIGS. 3 or 4, through which combustion products may flow to heat the outer surfaces of the shell sections for heat exchange with air flowing over the exterior of the heat exchanger unit. The heat exchanger 10 includes a lower pouch section 18 including an opening 20 for reception of a burner unit, for example, and an upper portion 22 including an exit opening 24 for combustion products.

Figure 3:
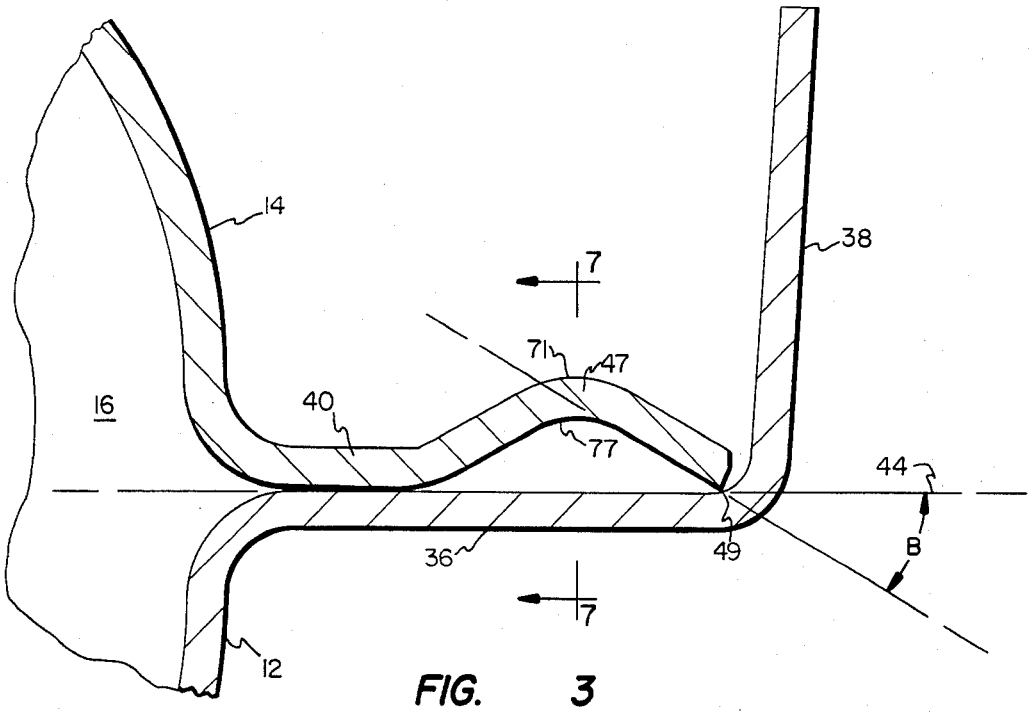
FIG. 3 is a detail section view of the shell sections similar to FIG. 4 but showing the flanges of the respective sections after formation of the raised bead or arched portion and before the final folding and crimping of the flanges.

The heat exchanger unit 10 is generally in accordance with the unit described and claimed in the aforementioned application and in U.S. Pat. No. 4,298,061. The heat exchanger unit 10 is sealed around its perimeter in accordance with the present invention and in accordance with the inventions in the aforementioned application and patent at each of top, bottom and opposed side edges 28, 30, 32 and 34, respectively. Along each of the aforementioned edges the section 12 is formed with a peripheral flange 36 which, as shown in FIG. 3, is initially formed with an upturned outer edge portion 38 when the section 12 itself is lying with its interior recessed portion facing upward. In like manner, the shell section 14 is formed with cooperating perimeter flange portions 40 in such a way that upon assembly of the shell section 14 over the shell section 12 to form the chamber 16 the flange 40 rests on the flange section 36. As shown in FIG. 1, and as described in the aforementioned application and in U.S. Pat. No. 4,298,061, each of the edges 28, 30, 32 and 34 is crimped in final assembly at a plurality of locations 41, and therebetween at locations 43 at an acute angle with respect to a central longitudinal plane 44, FIGS. 3 and 4. The crimping of the aforementioned peripheral edges of the exchanger unit 10 creates a scissor action on the small displaced areas of the flanges formed by the crimped locations 41 and 43 as described in the referenced application and patent, the disclosure of which is incorporated herein by reference.

Figure 4:
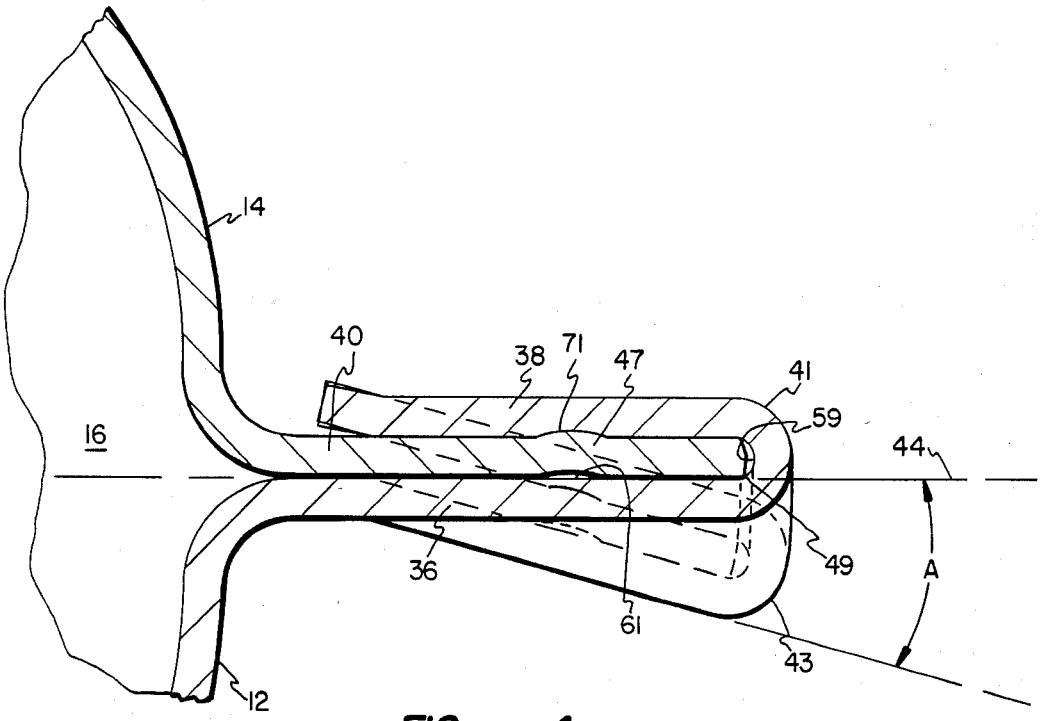
FIG. 4 is a detail section view taken along the line 4—4 of FIG. 1 and showing the relationship of the flanges after the forming process.
Figure 5:
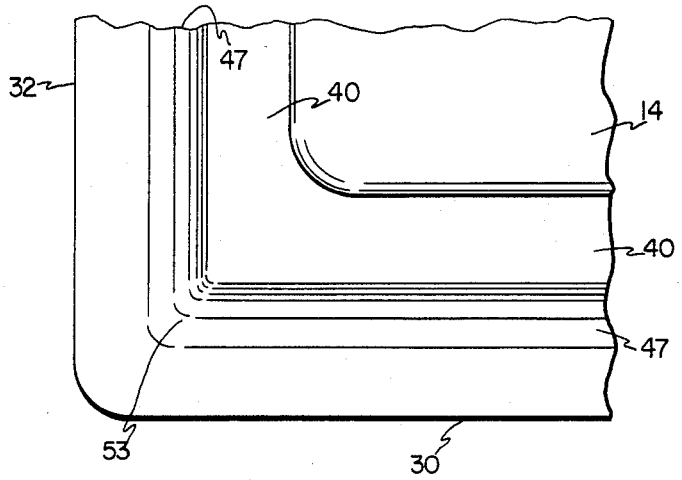
FIG. 5 is a detail plan view of a corner of the shell section including the beaded flange.
Figure 6:
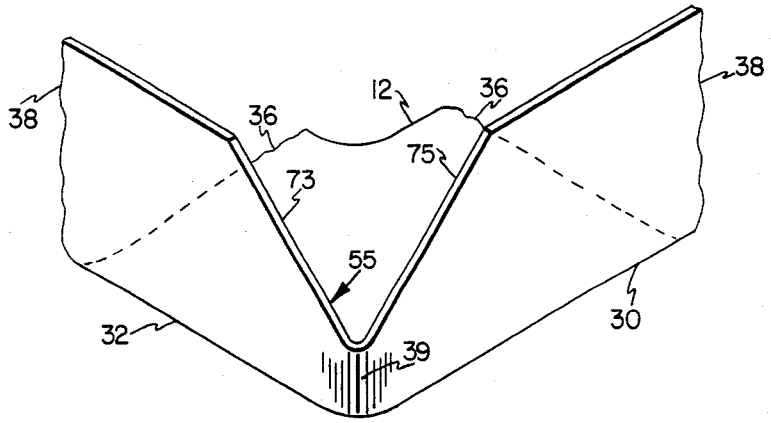
FIG. 6 is a detail perspective view of two intersecting flanges of the other shell section before the folding operation.
Figure 7:
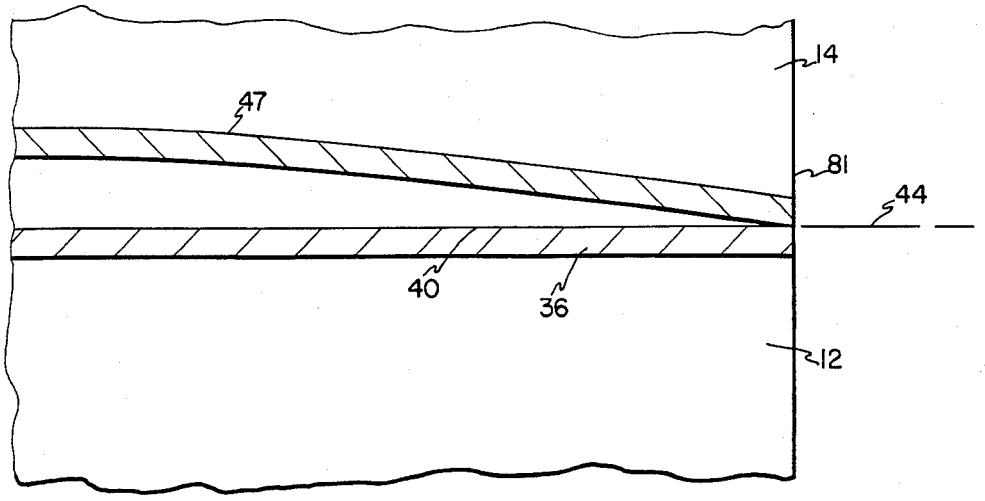
FIG. 7 is a detail section view taken along the line 7—7 of FIG. 3 and illustrating the blending out of the flange bead.

In accordance with the present invention each of the flange portions 40 of the shell section 14 is provided with an elongated raised or arched bead or ridge, generally designated by the numeral 47 in FIGS. 3 and 4, by displacing a portion of the flange in accordance with a conventional die forming operation, for example. The formation of the bead 47 is preferably carried out by displacing the outer edge portion of the flange 40 away from the plane 44 and causing the longitudinal edge 49 to lie in a plane forming an acute angle B with respect to the plane 44 as indicated in FIG. 3. As shown in FIG. 5, the beads 47 extending along the edges 30 and 32, for example, intersect to form a continuous ridge corner 53. The intersection of the edges 28 and 32 is also formed with a ridge portion 53. FIG. 6 illustrates the complementary corner portions of the flanges 36 formed along the edges 30 and 32 of the shell section 12 which, as shown by way of example, are formed to include a generally V-shaped notch 55 extending from the outer peripheral edge of the flange sections 38 approximately three-quarters of the width of that flange section to leave an upstanding flange portion 39 of reduced height. A notch 55 is also formed at the intersection of the flange portions 38 for the edges 28 and 30, each notch 55 having an included angle of approximately 90°.

Where the flanges 40 terminate at a lateral edge, such as at 81, 83 and 85 in FIG. 1, the bead 47 is blended out to the plane 44 which is coincident with the flange 40, as shown in FIG. 7 by way of example.

In the process of manufacturing the heat exchanger unit 10 the shell sections 12 and 14 are separately formed by conventional forging equipment to form the recessed portions of the sections and the respective integral flanges 36 and 40. The forging process may include the formation of the bead 47 along each flange 40 of the section 14 and folding of the flange portions 38 in the direction indicated to the position shown in FIG. 3 during the formation of the sections 12. The shell section 14 is then nested within the shell section 12, as indicated in FIG. 3, with the shell section 12 in a die apparatus which is capable of folding the flange portion 38 over the bead 47 and the flange 40 to the position illustrated in FIG. 4. The process of folding the flange portion 38 over to sandwich the flange 40 between the opposed portions 36 and 38 forms a substantially gas-tight seal around the edges of the heat exchanger unit thanks to the displacement of the bead 47 which is reduced in height by approximately 90%, as illustrated, when comparing the remaining portion of the bead as shown in FIG. 4. The folding process results in the edge 49 of the flange 40 being forcibly engaged with the surface of the flange 36 near its juncture with the flange portion 38 to dig into the material of the flange 36. Any burrs or flash left on the edge 49 as a result of the formation of the shell section 14 is of assistance in forming a gas-tight seal between the shell sections at the small space or gap 59, FIG. 4, remaining between the outer edge 49 and the base of a recess formed between the opposed flange portions 36 and 38 which is filled by the flange 40. The blended out portions at the lateral edges 81, 83 and 85, as shown by way of example in FIG. 7, assures that no gap between the flanges 40 and 36 remain for possible leakage of fluid at the ends of these edges and along a small passage which may be formed by a residual gap 61 as shown in FIG. 4.

As described previously the formation of the displaced ridge portion or bead 47 along the flanges 40 provides the advantage that upon folding the flange portion 38 downward into the pressed position shown in FIG. 4 the outer edge 49 of the flange 40 is forced into the bottom of the recess leaving only the small gap 59 or no gap at all, thereby forming a better edge seal for the seam between the contiguous surfaces of the flanges 40 and 36. Moreover, the formation of the bead 47 and the displacement thereof into the position shown in FIG. 4 is such as to leave enough elastic memory in the bead portion which tends to cause the upper surface 71 of the bead to press against the flange portion 38 while the edge 49 tends to press into the adjacent surface of the flange 36 thereby enhancing the seal along the seam between the flanges of the shell sections 12 and 14.

The corners of the flanges 36 are formed generally in accordance with the description of the corner of the flanges in U.S. Pat. No. 4,298,061. However, as shown in FIG. 6 the reduced portion 39 of the flange portion 38 is of sufficient height which, when folded over will engage and displace the corner portion of the bead 47 in substantially the same manner that the lineal portions of the bead are displaced. The opposed edges 73 and 75 of the notch 55 are dimensioned to lie substantially adjacent each other in the folded position. Accordingly, any excess flange material is displaced into any unoccupied crevices between the edges 73 and 75 or any area that the folding die will accommodate.

Subsequent to the folding of the flange portions 38 and displacement of the beads 47, each of the edges 28, 30, 32 and 34 may be crimped in accordance with the teaching of the above referenced patent to form a substantially leakproof or gas-tight seal along the peripheral edges of the heat exchanger unit which will prevent undesirable movement between the shell sections during the alternate heating and cooling cycles encountered by heat exchangers used in gas fired hot air furnaces for residential and commercial applications, for example. Preferably, each of the edges 28, 30, 32 and 34 is crimped parallel to the central longitudinally extending plane 44 at a plurality of locations 41, and therebetween at locations 43 at an acute angle A with respect to said plane to thereby create a scissors action on small areas along the perimeter between these locations. Such action securely locks the two shell sections 12 and 14 together.

The heat exchanger 10 may be manufactured of conventional material such as 16 to 20 gauge (U.S. Std.) sheet steel. The height of the bead 47 from the plane 44 to the inner surface 77 of the bead, FIG. 3, may be on the order of 0.0625 inches for an ideal flange thickness of 0.0335 inches.

Conventional press forming or crimping equipment which has been modified to accommodate the specific configuration of the heat exchanger unit 10 may be used to fold the flange portions 38 and perform the crimping operation to form the crimped edges described. Preferably, the equipment is adapted to perform the folding and crimping operations in a single step. The heat exchanger unit 10 is typically provided in a plurality of units secured to a heat exchanger plate assembly.

Those skilled in the art will recognize that the invention described and claimed herein may be subject to various alterations and modifications of the structure and the method without departing from the scope and spirit of the invention as defined in the appended claims.

What I claim is:

1. A method of joining opposed sheet metal sections of a heat exchanger unit along an edge thereof wherein each of said sections is provided with a flange adapted to be joined to the cooperating flange of the other section, comprising the steps of:

forming a generally elongated continuous bead on the flange of one of said sections extending adjacent to an outer longitudinal edge of said flange of said one section by displacing a portion of said flange of said one section away from a plane coincident with said flange of said one section to form a ridge which is elastically displaceable by a portion of said flange of said other section;

forming said other section with a flange of sufficient width to permit folding said portion of said flange of said other section over the flange of said one section;

placing said sections opposite each other with said flanges aligned;

folding said portion of said flange of said other section over said flange of said one section and pressing said portion of said flange of said other section against said bead sufficiently to elastically displace said ridge toward said plane coincident with said flange of said one section and said longitudinal edge into engagement with said flange of said other section to form a seal between said flanges at said ridge and at said longitudinal edge.

2. The method set forth in claim 1 and further including the steps of:

crimping said flanges together at a plurality of locations after folding said flange of said other section over said flange of said one section and causing said flanges at such locations to extend in one direction with respect to a longitudinally extending plane through said heat exchanger, and crimping said flanges together between the said locations and causing said flanges at the between locations to extend in another direction with respect to said longitudinally extending plane to create a scissor action between the crimped flange portions extending in the different directions to thereby securely clamp and seal said heat exchanger along said edge.

3. The method set forth in claim 2 wherein:

said heat exchanger is provided cooperating flanges on top, bottom and opposed side edges of said sections, and the steps of folding and crimping are each performed simultaneously along said top, bottom and opposed side edges of said heat exchanger.

4. The method set forth in claim 3 wherein:

the folded flanges are caused to meet along mitered edges at corners of the heat exchanger and flange material is squeezed between said edges to form a leakproof corner joint.

5. The method set forth in claim 1 wherein:

said step of forming said bead includes displacing a portion of said flange of said one section including said longitudinal edge to lie in a plane forming an acute angle with said plane coincident with said flange of said one section.

6. The method set forth in claim 1 wherein:

said displaced portion of said flange of said one section is tapered toward said plane coincident with said flange of said one section at a lateral edge of said flange of said one section.

7. A method of joining opposed sheet metal sections of a furnace heat exchanger unit along an edge thereof to form a substantially gas tight seal between said sections during repeated heating and cooling cycles of said heat exchanger unit wherein each of said sections is provided with a flange adapted to be joined to the cooperating flange of the other section, comprising the steps of:

forming a generally elongated continuous bead on the flange of one of said sections extending along and adjacent to a longitudinal outer edge of said flange of said one section by displacing a portion of said flange of said one section away from a plane coincident with said flange of said one section to form a ridge which is elastically displaceable by said flange of said other section and to position said longitudinal edge of said flange of said one section in position to forcibly engage with flange of said other section;

forming said other section with a flange of sufficient width to permit folding said flange of said other section over said flange of said one section;

placing said sections opposite each other with said flanges aligned;

folding a portion of said flange of said other section over said flange of said one section and pressing said portion of said flange of said other section against said bead sufficiently to substantially displace said ridge toward said plane coincident with said one section to form a seal along said flanges between said ridge and said portion of said flange of said other section and to form a seal between said longitudinal edge and said flange of said other section.

* * * * *